US009502050B2

(12) United States Patent
Buck et al.

(10) Patent No.: US 9,502,050 B2
(45) Date of Patent: Nov. 22, 2016

(54) NOISE DEPENDENT SIGNAL PROCESSING FOR IN-CAR COMMUNICATION SYSTEMS WITH MULTIPLE ACOUSTIC ZONES

(71) Applicant: NUANCE COMMUNICATIONS, INC., Burlington, MA (US)

(72) Inventors: Markus Buck, Biberach (DE); Tobias Herbig, Ulm (DE); Meik Pfeffinger, Ulm (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 33 days.

(21) Appl. No.: 14/406,628

(22) PCT Filed: Dec. 26, 2012

(86) PCT No.: PCT/US2012/071646

§ 371 (c)(1),
(2) Date: Dec. 9, 2014

(87) PCT Pub. No.: WO2013/187932

PCT Pub. Date: Dec. 19, 2013

(65) Prior Publication Data

US 2015/0127351 A1 May 7, 2015

Related U.S. Application Data

(60) Provisional application No. 61/657,863, filed on Jun. 10, 2012.

(51) Int. Cl.
*G10L 21/00* (2013.01)
*G10L 25/48* (2013.01)
(Continued)

(52) U.S. Cl.
CPC ..... *G10L 25/48* (2013.01); *G10L 21/02* (2013.01); *H04R 1/00* (2013.01);
(Continued)

(58) Field of Classification Search
CPC ..... G10L 21/02; H04R 3/00; H04R 1/26
USPC ..... 704/225
See application file for complete search history.

(56) References Cited

U.S. PATENT DOCUMENTS 4,015,088 A 3/1977 Dubnowski et al.
4,052,568 A 10/1977 Jankowski
(Continued)

FOREIGN PATENT DOCUMENTS

CN 1877517 A 12/2006
CN 101154382 A 4/2008
(Continued)

OTHER PUBLICATIONS

Notification of Transmittal of the International Search Report and the Written Opinion of the International Searching Authority, or the Declaration, PCT/US2013/027738, date of mailing Apr. 26, 2013, 4 pages.
(Continued)

*Primary Examiner* — Daniel Abebe
(74) *Attorney, Agent, or Firm* — Daly, Crowley Mofford & Durkee, LLP

(57) ABSTRACT

A speech communication system includes a speech service compartment for holding one or more system users. The speech service compartment includes a plurality of acoustic zones having varying acoustic environments. At least one input microphone is located within the speech service compartment, for developing microphone input signals from the one or more system users. At least one loudspeaker is located within the service compartment. An in-car communication (ICC) system receives and processes the microphone input signals, forming loudspeaker output signals that are provided to one or more of the at least one output loudspeakers. The ICC system includes at least one of a speaker dedicated signal processing module and a listener specific signal processing module, that controls the processing of the microphone input signal and/or forming of the loudspeaker output signal based, at least in part, on at least one of an associated acoustic environment(s) and resulting psychoacoustic effect(s).

16 Claims, 3 Drawing Sheets

(51) Int. Cl.

| | |
|---|---|
| ***G10L 21/02*** | (2013.01) |
| ***H04R 1/00*** | (2006.01) |
| *H04R 3/00* | (2006.01) |
| *G10L 21/0364* | (2013.01) |
| *G10L 21/0216* | (2013.01) |
| *H04S 7/00* | (2006.01) |

(52) U.S. Cl.

CPC ..... *G10L 2021/02166* (2013.01); *G10L 2021/03646* (2013.01); *H04R 3/005* (2013.01); *H04R 2499/13* (2013.01); *H04R 2499/15* (2013.01); *H04S 7/302* (2013.01)

(56) References Cited

U.S. PATENT DOCUMENTS

| | | | | |
|---|---|---|---|---|
| 4,057,690 | A | 11/1977 | Vagliani et al. | |
| 4,359,064 | A | 11/1982 | Kimble | |
| 4,410,763 | A | 10/1983 | Strawczynski et al. | |
| 4,672,669 | A | 6/1987 | DesBlache et al. | |
| 4,688,256 | A | 8/1987 | Yasunaga | |
| 4,764,966 | A | 8/1988 | Einkauf et al. | |
| 4,825,384 | A | 4/1989 | Sakurai | |
| 4,829,578 | A | 5/1989 | Roberts | |
| 4,864,608 | A | 9/1989 | Miyamoto et al. | |
| 4,914,692 | A | 4/1990 | Hartwell et al. | |
| 5,033,082 | A | 7/1991 | Eriksson et al. | |
| 5,034,984 | A | 7/1991 | Bose | |
| 5,048,080 | A | 9/1991 | Bell et al. | |
| 5,125,024 | A | 6/1992 | Gokcen et al. | |
| 5,155,760 | A | 10/1992 | Johnson et al. | |
| 5,220,595 | A | 6/1993 | Uehara | |
| 5,239,574 | A | 8/1993 | Brandman et al. | |
| 5,349,636 | A | 9/1994 | Irribarren | |
| 5,394,461 | A | 2/1995 | Garland | |
| 5,416,887 | A | 5/1995 | Shimada | |
| 5,434,916 | A | 7/1995 | Hasegawa | |
| 5,475,791 | A | 12/1995 | Schalk et al. | |
| 5,574,824 | A | 11/1996 | Slyh et al. | |
| 5,577,097 | A | 11/1996 | Meek | |
| 5,581,620 | A | 12/1996 | Brandstein et al. | |
| 5,602,962 | A | 2/1997 | Kellermann | |
| 5,652,828 | A | 7/1997 | Silverman | |
| 5,708,704 | A | 1/1998 | Fisher | |
| 5,708,754 | A | 1/1998 | Wynn | |
| 5,721,771 | A | 2/1998 | Higuchi et al. | |
| 5,761,638 | A | 6/1998 | Knittle et al. | |
| 5,765,130 | A | 6/1998 | Nguyen | |
| 5,784,484 | A | 7/1998 | Umezawa | |
| 5,959,675 | A | 9/1999 | Mita et al. | |
| 5,978,763 | A | 11/1999 | Bridges | |
| 6,018,711 | A | 1/2000 | French-St. George et al. | |
| 6,061,651 | A | 5/2000 | Nguyen | |
| 6,098,043 | A | 8/2000 | Forest et al. | |
| 6,246,986 | B1 | 6/2001 | Ammicht et al. | |
| 6,266,398 | B1 | 7/2001 | Nguyen | |
| 6,279,017 | B1 | 8/2001 | Walker | |
| 6,363,156 | B1 * | 3/2002 | Roddy | H04M 1/6083 381/71.4 |
| 6,373,953 | B1 | 4/2002 | Flaks | |
| 6,449,593 | B1 | 9/2002 | Valve | |
| 6,496,581 | B1 | 12/2002 | Finn et al. | |
| 6,526,382 | B1 | 2/2003 | Yuschik | |
| 6,549,629 | B2 | 4/2003 | Finn et al. | |
| 6,574,595 | B1 | 6/2003 | Mitchell et al. | |
| 6,636,156 | B2 | 10/2003 | Damiani et al. | |
| 6,647,363 | B2 | 11/2003 | Claassen | |
| 6,717,991 | B1 | 4/2004 | Gustafsson et al. | |
| 6,778,791 | B2 | 8/2004 | Shimizu et al. | |
| 6,785,365 | B2 | 8/2004 | Nguyen | |
| 6,842,528 | B2 | 1/2005 | Kuerti et al. | |
| 7,065,486 | B1 | 6/2006 | Thyssen | |
| 7,068,796 | B2 | 6/2006 | Moorer | |
| 7,069,213 | B2 | 6/2006 | Thompson | |
| 7,069,221 | B2 | 6/2006 | Crane et al. | |
| 7,117,145 | B1 | 10/2006 | Venkatesh et al. | |
| 7,162,421 | B1 | 1/2007 | Zeppenfeld et al. | |
| 7,171,003 | B1 | 1/2007 | Venkatesh et al. | |
| 7,206,418 | B2 | 4/2007 | Yang et al. | |
| 7,224,809 | B2 | 5/2007 | Hoetzel | |
| 7,274,794 | B1 | 9/2007 | Rasmussen | |
| 7,643,641 | B2 | 1/2010 | Haulick et al. | |
| 8,000,971 | B2 | 8/2011 | Ljolje | |
| 8,050,914 | B2 | 11/2011 | Schmidt et al. | |
| 8,121,307 | B2 * | 2/2012 | Yamaguchi | H03G 3/32 381/104 |
| 8,873,774 | B2 | 10/2014 | Rijken et al. | |
| 9,008,322 | B2 | 4/2015 | Botti et al. | |
| 2001/0038698 | A1 | 11/2001 | Breed et al. | |
| 2002/0184031 | A1 | 12/2002 | Brittan et al. | |
| 2003/0026437 | A1 | 2/2003 | Janse et al. | |
| 2003/0063756 | A1 * | 4/2003 | Geerlings | H04R 5/02 381/86 |
| 2003/0072461 | A1 | 4/2003 | Moorer | |
| 2003/0185410 | A1 | 10/2003 | June et al. | |
| 2004/0047464 | A1 | 3/2004 | Yu et al. | |
| 2004/0076302 | A1 | 4/2004 | Christoph | |
| 2004/0230637 | A1 | 11/2004 | Lecoueche et al. | |
| 2005/0265560 | A1 | 12/2005 | Haulick et al. | |
| 2006/0222184 | A1 | 10/2006 | Buck et al. | |
| 2006/0233391 | A1 | 10/2006 | Park et al. | |
| 2006/0262935 | A1 | 11/2006 | Goose et al. | |
| 2007/0230712 | A1 | 10/2007 | Belt et al. | |
| 2008/0004875 | A1 | 1/2008 | Chengalvarayan et al. | |
| 2008/0004881 | A1 | 1/2008 | Attwater et al. | |
| 2008/0107280 | A1 | 5/2008 | Haulick et al. | |
| 2008/0144855 | A1 * | 6/2008 | Wimer | B60R 11/0247 381/86 |
| 2008/0226098 | A1 | 9/2008 | Haulick et al. | |
| 2008/0279366 | A1 | 11/2008 | Lindbergh | |
| 2008/0304679 | A1 | 12/2008 | Schmidt et al. | |
| 2009/0306937 | A1 | 12/2009 | Chen | |
| 2009/0316923 | A1 | 12/2009 | Tashev et al. | |
| 2010/0035663 | A1 * | 2/2010 | Haulick | H04M 1/6083 455/569.2 |
| 2010/0189275 | A1 | 7/2010 | Christoph | |
| 2010/0223054 | A1 | 9/2010 | Nemer et al. | |
| 2011/0004470 | A1 | 1/2011 | Konchitsky et al. | |
| 2011/0026734 | A1 | 2/2011 | Hetherington et al. | |
| 2012/0128163 | A1 | 5/2012 | Moerkebjerg et al. | |
| 2012/0148067 | A1 | 6/2012 | Petersen et al. | |
| 2012/0191447 | A1 | 7/2012 | Joshi | |
| 2012/0201396 | A1 * | 8/2012 | Schmidt | G10L 21/02 381/71.1 |
| 2013/0039514 | A1 * | 2/2013 | Knowles | H04R 1/26 381/107 |
| 2013/0294612 | A1 | 11/2013 | Feng et al. | |

FOREIGN PATENT DOCUMENTS

| | | | |
|---|---|---|---|
| CN | 101350108 | A | 1/2009 |
| CN | 102035562 | A | 4/2011 |
| CN | 102239705 | A | 11/2011 |
| CN | 102474694 | A | 5/2012 |
| DE | 101 56 954 | A1 | 6/2003 |
| DE | 10 2005 002 865 | B3 | 6/2006 |
| EP | 0 856 834 | A2 | 8/1998 |
| EP | 1 083 543 | A2 | 3/2001 |
| EP | 1 116 961 | A2 | 7/2001 |
| EP | 1 343 351 | A1 | 9/2003 |
| EP | 1 850 640 | A1 | 10/2007 |
| EP | 2 107 553 | A1 | 10/2009 |
| EP | 2 148 325 | A1 | 1/2010 |
| GB | 2 097 121 | A | 10/1982 |
| JP | 2010157964 | | 7/2010 |
| WO | WO 94/18666 | | 8/1994 |
| WO | WO 02/32356 | A1 | 4/2002 |
| WO | WO 2004/100602 | A2 | 11/2004 |

(56) References Cited

FOREIGN PATENT DOCUMENTS

WO WO 2006/117032 A 11/2006
WO WO 2011/119168 A1 9/2011

OTHER PUBLICATIONS

Written Opinion of the International Searching Authority, PCT/US2013/027738, date of mailing Apr. 26, 2013, 5 pages.
International Preliminary Report on Patentability, PCT/US2013/027738, date of issuance Mar. 10, 2015, 6 pages.
U.S. Appl. No. 14/406,629, filed Dec. 9, 2014, Herbig, et al.
PCT International Preliminary Report on Patentability for PCT/US2012/071646 dated Dec. 24, 2014 7 pages.
PCT International Search Report for PCT/US2012/071646 dated Mar. 8, 2013 4 pages.
PCT Written Opinion of the International Searching Authority for PCT/US2012/071646 dated Mar. 8, 2013 8 pages.
Response dated May 10, 2016 to Office Action dated Apr. 4, 2016; for U.S. Appl. No. 14/406,629; 9 pages.
U.S. Final Office Action dated May 25, 2016 corresponding to U.S. Appl. No. 14/406,629; 6 Pages.
Chinese Patent Application No. 201380040082.6 Notification of the First Office Action dated Jan. 14, 2016, including translation, 19 pages.
U.S. Appl. No. 14/406,629 Response to Office Action filed May 10, 2016, 11 pages.
U.S. Appl. No. 14/406,629 Office Action dated Apr. 4, 2016, 14 pages.
European Application No. 12878823.9-1901 Partial Supplementary European Search Report dated Mar. 8, 2016, 7 pages.
Sang-Mun Chi et al.,: "Lombard effect compensation and noise suppression for noisy Lombard speech recognition", Spoken Language, 1996. ICSLP 96. Proceedings., Fourth International Conference on Philadelphia, PA, USA Oct. 3-6, 1996, New York, NY, USA, IEEE, US, vol. 4, Oct. 3, 1996, pp. 2013-2016, XP010238177, DOI: 10.1109/ICSLP.1996.607193. ISBN: 978-0-7803-3555-4. 4 pages.
Jung et al.,: "On the Lombard Effect Induced by Vehicle Interior Driving Noises, Regarding Sound Pressure Level and Long-Term Average Speech Spectrum", Acustica United with ACTA Acustica, S. Hirzel Verlag, Stuttgart, DE, vol. 98, Mar. 1, 2012, pp. 334-341, XP008178809, ISSN: 1610-1928, DOI: 10.3813/AAA.918517, 8 pages.
Richardson et al. "LPC-Synthesis Mixture: A Low Computational Cost Speech Enhancement Algorithm", Proceedings of the IEEE, Apr. 11, 1996, 4 pages.
Arslan et al. "New Methods for Adaptive Noise Suppression," IEEE, vol. 1, May 1995, 4 pages.
Ljolje et al. "Discriminative Training of Multi-Stage Barge-in Models," IEEE, Dec. 1, 2007, 6 pages.
Setlur et al. "Recognition-based Word Counting for Reliable Barge-In and Early Endpoint Detection in Continuous Speech Recognition," International Conference on spoken Language Processing, Oct. 1, 1998, 4 pages.
Ittycheriah et al. "Detecting User Speech in Barge-in Over Prompts Using Speaker Identification Methods," Eurospeech 99, Sep. 5, 1999, 4 pages.
Rose et al. "A Hybrid Barge-In Procedure for More Reliable Turn-Taking in Human-Machine Dialog Systems," 5$^{th}$ International Conference on Spoken Language Processing, Oct. 1, 1998, 6 pages.
Hansler et al. "Acoustic Echo and Noise Control: A Practical Approach", John Wiley & Sons, New York, New York, Usa, Copyright 2004, Part 1, 250 pages.
Hansler et al. "Acoustic Echo and Noise Control: A Practical Approach", John Wiley & Sons, New York, New York, Usa, Copyright 2004, Part 2, 221 pages.
Sang-Mun Chi et al: "Lombard effect compensation and noise suppression for noisy Lombard speech recognition", IEEE, US, vol. 4, Oct. 3, 1996 pp. 2013-2016, 4 pages.
Schmidt et al: "Signal processing for in-car communication systems", Signal Processing, Elsevier Science Publishers B.V. Amsterdam, NL, vol. 86, No. 6, Jun. 1 2006, pp. 1307-1326, 20 pages.
Jung et al: "On the Lombard Effect Induced by Vehicle Interior Driving Noises, Regarding Sound Pressure Level and Long-Term Average Speech Spectrum", Mar. 1, 2012, pp. 334-341, ISSN: 1610-1928, 8 pages.
Alfonso Ortega et al: "Cabin car communication system to improve communications inside a car", IEEE, May 13, 2002, pp. IV-3836, 4 pages.
Extended Search Report dated Sep. 19, 2008 for European Application No. 08013196.4; 11 pages.
Decision to grant dated Feb. 28, 2014 for European Application No. 08013196.4; 52 pages.
Supplemental Decision to grant dated May 27, 2014 for European Application No. 08013196.4; 43 pages.
Office Action dated Apr. 1, 2013 for U.S. Appl. No. 12/507,444, 17 pages.
Response to Office Action dated Aug. 1, 2013 U.S. Appl. No. 12/507,444, 16 pages.
Final Office Action dated Nov. 15, 2013 for U.S. Appl. No. 12/507,444, 19 pages.
Office Action dated Jun. 14, 2013 for U.S Appl. No. 12/254,488; 22 pages.
Response to Office Action dated Dec. 4, 2013 for U.S Appl. No. 12/254,488; 12 pages.
Notice of Allowance dated Dec. 23, 2013 for U.S Appl. No. 12/254,488; 11 pages.
European Search Report Apr. 24, 2008 for European Application No. 07021121.4, 3 pages.
European Extended Search Report dated May 6, 2008 for European Application No. 07021121.4, 3 pages.
European Search Report dated Jun. 14, 2011 for European Application No. 07021932.4, 2 pages.
Decision to Grant dated Dec. 5, 2013 for European Application No. 07021932.4, 1 page.
International Preliminary Report on Patentability dated Nov. 11, 2005 for PCT Application No. PCT/EP2004/004980; 8 pages.
Written Opinion dated Nov. 8, 2004 for PCT Application No. PCT/EP2004/004980; 7 pages.
Search Report dated Nov. 8, 2004 for PCT Application No. PCT/EP2004/004980; 3 pages.
Office Action dated Nov. 28, 2007 for U.S. Appl. No. 10/556,232; 11 pages.
Response to Office Action files Mar. 28, 2008 for U.S. Appl. No. 10/556,232; 7 pages.
Office Action dated May 29, 2008 for U.S. Appl. No. 10/556,232; 10 pages.
Response to Office Action files Aug. 29, 2008 for U.S. Appl. No. 10/556,232; 9 pages.
Office Action dated Dec. 9, 2008 for U.S. Appl. No. 10/556,232; 17 pages.
Response to Office Action files Mar. 9, 2009 for U.S. Appl. No. 10/556,232; 13 pages.
Office Action dated May 13, 2009 for U.S. Appl. No. 10/556,232; 17 pages.
Response to Office Action files May 29, 2009 for U.S. Appl. No. 10/556,232; 6 pages.
Notice of Allowance dated Aug. 26, 2009 for U.S. Appl. No. 10/556,232; 7 pages.
Notice of Allowance dated Jan. 15, 2014 for U.S. Appl. No. 11/924,987; 7 pages.
Office Action dated Jan. 7, 2014 for U.S. Appl. No. 13/518,406; 10 pages.
Response to Office Action filed May 5, 2014 for U.S. Appl. No. 13/518,406; 8 pages.
Final Office Action dated Jun. 10, 2014 for U.S. Appl. No. 13/518,406; 10 pages.
Response to Final Office Action filed Nov. 13, 2014 for U.S. Appl. No. 13/518,406; 11 pages.
Office Action dated Nov. 26, 2014 for U.S. Appl. No. 13/518,406; 6 pages.

(56) References Cited

OTHER PUBLICATIONS

Response to Office Action filed Feb. 17, 2015 for U.S. Appl. No. 13/518,406; 9 pages.
Notice of Allowance dated Mar. 10, 2015 for U.S. Appl. No. 13/518,406; 7 pages.
European Office Action dated Oct. 16, 2014 for European Application No. 10716929.4; 5 pages.
Decision to grant dated Jan. 18, 2016 for European Application No. 10716929.4; 24 pages.
Response to Written Opinion filed Jan. 9, 2015 for European Application No. 10716929.4; 9 pages.
International Preliminary Report on Patentability dated Oct. 2, 2012 for PCT Application No. PCT/US2010/028825; 8 pages.
Search Report dated Dec. 28, 2010 for PCT Application No. PCT/US2010/028825; 4 pages.
Written Opinion 2010 dated Dec. 28, 2010 for PCT Application No. PCT/US2010/028825; 7 pages.
Extended Search Report dated Jul. 20, 2016 for European Application No. 12878823.9; 16 pages.
Supplementary Search Report dated Aug. 5, 2016 for European Application No. 12878823.9; 1 pages.
Response to Office Action dated Jun. 7, 2016 for Chinese Application No. 201380040082.6; 8 pages.
Final Office Action dated Aug. 29, 2016 for U.S. Appl. No. 14/423,543; 16 pages.
International Preliminary Report on Patentability dated May 14, 2015 for PCT Application No. PCT/US2012/062549; 6 pages.
Office Action dated Feb. 16, 2016 for U.S. Appl. 14/438,757; 12 pages.
Response to Office Action dated May 13, 2016 for U.S. Appl. 14/438,757; 15 pages.
Final Office Action dated Jul. 28, 2016 for U.S. Appl. 14/438,757; 12 pages.
EPO Extended Search Report dated Jun. 27, 2011 for European Application No. 11155021.6; 10 pages.
EPO Communication Pursuant to Article 94(3) EPC dated Jul. 5, 2013 for European Application No. 11155021.6; 2 pages.
Response to EPO Communication Pursuant to Article 94(3) EPC dated Oct. 8, 2013 for European Application No. 11155021.6; 11 pages.
Image file Wrapper Part 1A downloaded on Aug. 29, 2016 for U.S. Appl. No. 11/928,251; 150 pages.
Image file Wrapper Part 1B downloaded on Aug. 29, 2016 for U.S. Appl. No. 11/928,251; 100 pages.
Image file Wrapper Part 2A downloaded on Aug. 29, 2016 for U.S. Appl. No. 11/928,251; 150 pages.
Image file Wrapper Part 2B downloaded on Aug. 29, 2016 for U.S. Appl. No. 11/928,251; 100 pages.
Image file Wrapper Part 3 downloaded on Aug. 29, 2016 for U.S. Appl. No. 11/928,251; 170 pages.
Image file Wrapper Part 1A downloaded on Aug. 29, 2016 for U.S. Appl. No. 12/507,444; 150 pages.
Image file Wrapper Part 1B downloaded on Aug. 29, 2016 for U.S. Appl. No. 12/507,444; 100 pages.
Image file Wrapper Part 2 downloaded on Aug. 29, 2016 for U.S. Appl. No. 12/507,444; 230 pages.
Image file Wrapper Part 1 downloaded on Aug. 29, 2016 for U.S. Appl. No. 12/254,488; 250 pages.
Image file Wrapper Part 2 downloaded on Aug. 29, 2016 for U.S. Appl. No. 12/254,488; 250 pages.
Image file Wrapper Part 3 downloaded on Aug. 29, 2016 for U.S. Appl. No. 12/254,488; 250 pages
Image file Wrapper Part 4 downloaded on Aug. 29, 2016 for U.S. Appl. No. 12/254,488; 30 pages.
Image file Wrapper downloaded on Aug. 29, 2016 for U.S. Appl. No. 12/269,605; 214 pages.
Image file Wrapper Part 1 downloaded on Aug. 29, 2016 for U.S. Appl. No. 13/273,890, 200 pages.
Image file Wrapper Part 2 downloaded on Aug. 29, 2016 for U.S. Appl. No. 13/273,890, 200 pages.
Image file Wrapper Part 3 downloaded on Aug. 29, 2016 for U.S. Appl. No. 13/273,890, 35 pages.
Image file Wrapper downloaded on Aug. 29, 2016 for U.S. Appl. No. 14/254,007, 176 pages.
Image file Wrapper Part 1 downloaded on Aug. 29, 2016 for U.S. Appl. No. 10/556,232; 200 pages.
Image file Wrapper Part 2 downloaded on Aug. 29, 2016 for U.S. Appl. No. 10/556,232; 165 pages.
Image file Wrapper Part 1A downloaded on Aug. 29, 2016 for U.S. Appl. No. 13/518,406; 150 pages.
Image file Wrapper Part 1B downloaded on Aug. 29, 2016 for U.S. Appl. No. 13/518,406; 100 pages.
Image file Wrapper Part 2 downloaded on Aug. 29, 2016 for U.S. Appl. No. 13/518,406; 96 pages.
Image file Wrapper Part 1 downloaded on Aug. 29, 2016 for U.S. Appl. No. 14/406,628; 159 pages.
Image file Wrapper Part 1 downloaded on Aug. 29, 2016 for U.S. Appl. No. 14/423,543; 150 pages.
Image file Wrapper Part 2 downloaded on Aug. 29, 2016 for U.S. Appl. No. 14/423,543; 136 pages.
Chinese Office Action (with English translation) dated Aug. 10, 2016; for Chinese Pat. App. No. 201280074944.2; 22 Pages.

* cited by examiner

NOISE DEPENDENT SIGNAL PROCESSING FOR IN-CAR COMMUNICATION SYSTEMS WITH MULTIPLE ACOUSTIC ZONES

CROSS REFERENCE TO RELATED APPLICATIONS

This application is a National Stage application of PCT/US2012/071646 filed on Dec. 26, 2012, and entitled "Noise Dependent Signal Processing For In-Car Communication Systems With Multiple Acoustic Zones," which claims the benefit of U.S. Provisional Patent Application No. 61/657,863, filed on Jun. 10, 2012, which are incorporated herein by reference.

TECHNICAL FIELD

The invention relates to speech signal processing, particularly in an automobile.

BACKGROUND ART

In-Car Communication (ICC) systems strive to enhance communication among passengers within a vehicle by compensating for acoustic loss between two dialog partners. There are several reasons for such an acoustic loss. For example, typically, the driver cannot turn around to listeners sitting on the rear seats of the vehicle, and therefore he speaks towards the wind shield. This may result in 10-15 dB attenuation of his speech signal.

To improve the intelligibility and sound quality in the communication path from front passengers to rear passengers, the speech signal is recorded by one or several microphones, processed by the ICC system and played back at the rear loudspeakers. Bidirectional ICC systems enhancing also the speech signals of rear passengers for front passengers may be realized by using two unidirectional ICC instances.

FIG. 1 shows an exemplary system for two acoustic zones which are represented by driver/front passenger and rear passengers. The signal processing modules used in each of the two zones of such a system usually include beamforming (BF), noise reduction (NR), signal mixing (e.g. for driver and front passenger), Automatic Gain Control (AGC), feedback suppression (notch), Noise Dependent Gain Control (NDGC) and equalization (EQ) as shown in FIG. 2. Beamforming steers the beam of a microphone array to dedicated speaker locations such as the driver's or co-driver's seat. Noise reduction is employed to avoid or at least to moderate background noise transmitted over the ICC system. In addition, sibilant sounds may be reduced by a so-called deesser. Since speakers generally differ in their speaking habits, especially their speech volume, an AGC may be used to obtain an invariant audio impression for rear passengers irrespective of the actual speaker. Feedback suppression is generally needed to ensure stability of the closed-loop comprising loudspeaker, vehicle interior and microphone. The NDGC is used to optimize the sound quality for the listener, especially the volume of the playback signal. Additionally, the playback volume may be controlled by a limiter. Equalizing is required to adapt the system to a specific vehicle and to optimize the speech quality for the rear passengers.

These standard approaches are generally sufficient for unidirectional and some bidirectional systems. In state-of-the-art systems, typically only one noise-dependent module (NDGC) is used in each ICC instance to adapt the system to different acoustic scenarios. However, optimal performance of such a system is often not obtained when the number of acoustic zones/scenarios associated with the ICC instance is increased. Furthermore, particularly challenging is obtaining a consistent audio impression for each listener irrespective of the driving situation. Depending on the acoustic environment several psychoacoustic effects occur. Due to the Lombard effect, the speaker will change his voice characteristics to remain intelligible for the listener. On the other hand the speech signal played back from the loudspeaker will be masked by background noise at the listener's location. When speaker and listener are located in two different acoustic zones, the background noise may differ significantly so that these two effects may diverge. For example, the driver may increase the level of a fan in front of him, while a listener's fan remains switched off. A similar situation is given when the driver opens his window. In both cases the driver might speak louder than necessary so that the combination of direct sound and loudspeaker is inconvenient for the listener.

SUMMARY OF THE EMBODIMENTS

In a first embodiment of the invention there is provided a speech communication system that includes a speech service compartment for holding one or more system users. The speech service compartment further includes a plurality of acoustic zones having varying acoustic environments. At least one input microphone is located within the speech service compartment, for developing microphone input signals from the one or more system users. At least one loudspeaker is located within the service compartment. An in-car communication (ICC) system receives and processes the microphone input signals, forming loudspeaker output signals that are provided to one or more of the at least one loudspeakers. The ICC system includes at least one of a speaker dedicated signal processing module and a listener specific signal processing module, that controls the processing of the microphone input signal and/or forming of the loudspeaker output signal based, at least in part, on at least one of an associated acoustic environment(s) and resulting psychoacoustic effect(s).

In accordance with related embodiments of the invention, the speech service compartment may be the passenger compartment of automobile, a boat, or a plane. The speaker dedicated signal processing module may compensate for the Lombard effect of a system user by, for example, utilizing, at least in part, a target peak level for the speech level that depends on the background noise of the system user. The ICC system may include a deesser that processes the microphone input signal based, at least in part, on the acoustic environment. The deesser may scale the aggressiveness of de-essing based on an expected noise masking effect. The ICC system may include a Noise Dependent Gain Control (NDGC) having adjustable gain characteristics that vary based on background noise levels. The NGDC may include a limiter module that uses noise specific characteristics in the acoustic environment(s) to process peaks individually in each loudspeaker output signal. The ICC system may process the microphone input signals and/or forms the loudspeaker output signals based, at least in part, on a determined masking effect of background noise in the acoustic environment(s). The speech service compartment may be associated with a vehicle, wherein when the vehicle is moving at a high speed, the ICC system performs increased noise reduction compared to when the vehicle is moving at a low speed. The ICC system may utilize a plurality of parameter sets in performing equalization, so as to balance speech quality and stability of the system. One or more of the parameter sets may be trained offline depending on the driving situation. The ICC system may utilize at least one of acoustic sensor-driven sensor information and non-acoustic vehicle provided signals to determine the parameter sets.

In accordance with another embodiment of the invention, a computer-implemented method using one or more computer processes for speech communication is provided. The method includes developing a plurality of microphone input signals received by a plurality of input microphones from a plurality of system users within a service compartment, the speech service compartment including a plurality of acoustic zones having varying acoustic environments. The microphone input signals are processed using at least one of a speaker dedicated signal processing module and a listener specific signal processing module, forming loudspeaker output signals that are provided to one or more of loudspeakers located within the speech service compartment. The processing includes controlling the processing of the microphone input signal and/or forming of the loudspeaker output signal based, at least in part, on at least one of an associated acoustic environment(s) and resulting psychoacoustic effect(s).

In accordance with related embodiments of the invention, the speech service compartment may be the passenger compartment of an automobile, a boat, or a plane. The method may include compensating for the Lombard effect of a system user by the speaker dedicated signal processing module. Compensating for the Lombard effect of a system user may include utilizing, at least in part, a target peak level for the speech level that depends on the background noise of the system user. The method may include de-essing, by the speaker dedicated signal processing module, the microphone input signal based, at least in part, on the acoustic environment. De-essing may include scaling the aggressiveness of de-essing based on an expected noise masking effect. The method may include providing a Noise Dependent Gain Control (NDGC) having adjustable gain characteristics that vary based on background noise levels. The NGDC may include a limiter module, the method further including, using, by the limiter module, noise specific characteristics in the associated acoustic environment(s) to process peaks individually in each loudspeaker output signal. The method may include processing the microphone input signals and/or forming the loudspeaker output signals based, at least in part, on a determined masking effect of background noise in the acoustic environment(s). The speech service compartment may be associated with a vehicle, the method further including performing increased noise reduction when the vehicle is moving at a high speed, compared to when the vehicle is moving at a low speed. A plurality of parameter sets may be utilized in performing equalization on at least one of the microphone input signals and/or loudspeaker output signals. One or more of the parameter sets may be trained offline depending on the driving situation. least one of acoustic sensor-driven sensor information and non-acoustic vehicle provided signals in determining the parameter sets.

In accordance with another embodiment of the invention, a computer program product encoded in a non-transitory computer-readable medium for speech communication is provided. The product includes program code for developing a plurality of microphone input signals received by a plurality of input microphones from a plurality of system users within a service compartment, the speech service compartment including a plurality of acoustic zones having varying acoustic environments. The product further includes program code for processing the microphone input signals using at least one of a speaker dedicated signal processing module and a listener specific signal processing module, forming loudspeaker output signals that are provided to one or more loudspeakers located within the service compartment. the processing including controlling the processing of the microphone input signal and/or forming of the loudspeaker output signal based, at least in part, on at least one of an associated acoustic environment(s) and resulting psychoacoustic effect(s).

In accordance with related embodiments of the invention, the speech service compartment may be the passenger compartment of an automobile, a boat or a plane. The product may further include program code for compensating for the Lombard effect of a system user by the speaker dedicated signal processing module, for example, by utilizing, at least in part, a target peak level for the speech level that depends on the background noise of the system user. The product may further include program code for de-essing, by the speaker dedicated signal processing module, the microphone input signal based, at least in part, on the acoustic environment. The program code for de-essing may include scaling the aggressiveness of de-essing based on an expected noise masking effect. The product may further include program code for a Noise Dependent Gain Control (NDGC) having adjustable gain characteristics that vary based on background noise levels. The program code for the NGDC may include program code for a limiter module that uses noise specific characteristics in the associated acoustic environment(s) to process peaks individually in each loudspeaker output signal. The program code for processing the microphone input signals, forming the loudspeaker output signals, may be based, at least in part, on a determined masking effect of background noise in the acoustic environment(s). The speech service compartment may be associated with a vehicle, the product further comprising program code for performing increased noise reduction when the vehicle is moving at a high speed, compared to when the vehicle is moving at a low speed. The product may include program code utilizing a plurality of parameter sets in performing equalization on at least one of the microphone input signals and/or loudspeaker output signals.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

In illustrative embodiments of the invention, a flexible signal processing system and methodology takes the different acoustic environments of a multi-zone ICC and the resulting psychoacoustic effects into consideration. Details are described below.

Figure 3:
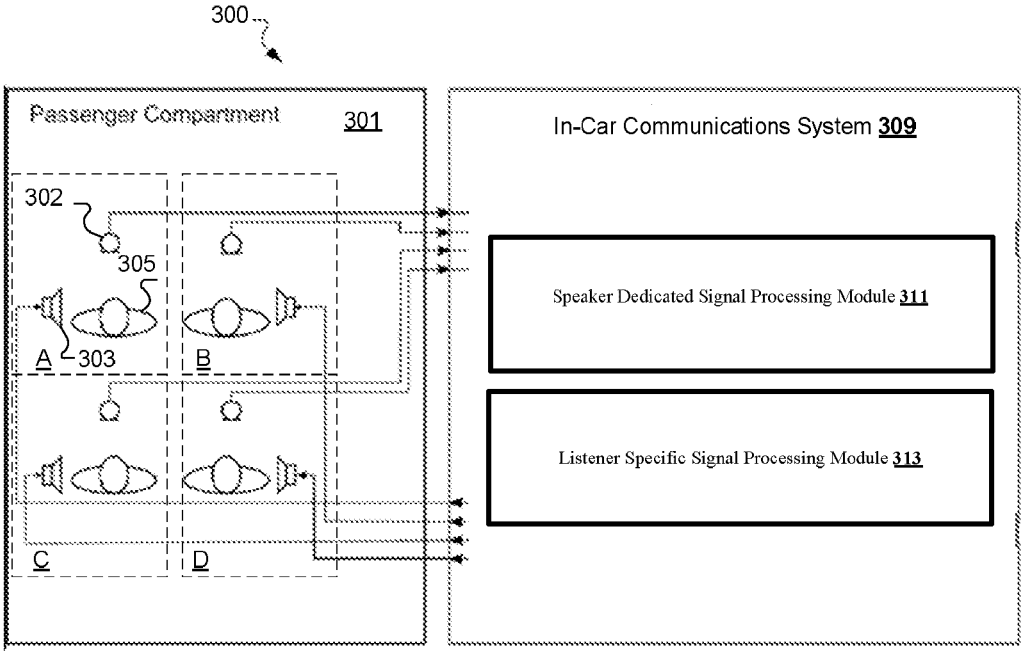
FIG. 3 shows an exemplary vehicle speech communication system which includes an In-Car Communication (ICC) system, in accordance with an embodiment of the invention.

FIG. 3 shows an exemplary speech communication system 300 which includes an In-Car Communication (ICC) system, in accordance with an embodiment of the invention. The speech communication system 300 may include hardware and/or software which may run on one or more computer processor devices. A speech service compartment, such as a passenger compartment 301 in an automobile is capable of holds one or more passengers who are system users 305. The passenger compartment 301 may also include multiple input microphones 302 that develop microphone input signals from the system users 305 to the speech communication system 300. Multiple output loudspeakers 303 develop loudspeaker output signals from the speech communication system 300 to the system users 305. While the ICC system is explicitly associated with a car, it is to be understood that the ICC system may be associated with any speech service compartment and/or vehicle, such as, without limitation, a boat or a plane.

The passenger compartment 301 may include a plurality of acoustic zones. Illustratively, four acoustic zones A, B, C and D are shown, however it is to be understood that any number of acoustic zones may be present. Each acoustic zone may represent a different, or potentially different, acoustic environment relative to the other acoustic zones.

The ICC system 309 enhances communication among the system users 305 by compensating for acoustic loss between system users 305. Microphone input signals from a system user 305 that are received by the ICC system 309 may be processed to maximize speech from that system user 305 and to minimize other audio sources including, for example, noise, and speech from other system users 305. Furthermore, based on the enhanced input signals, the ICC system 309 may produce optimized loudspeaker output signals to one or more output loudspeakers 303 for various system user(s) 305.

Figure 1:
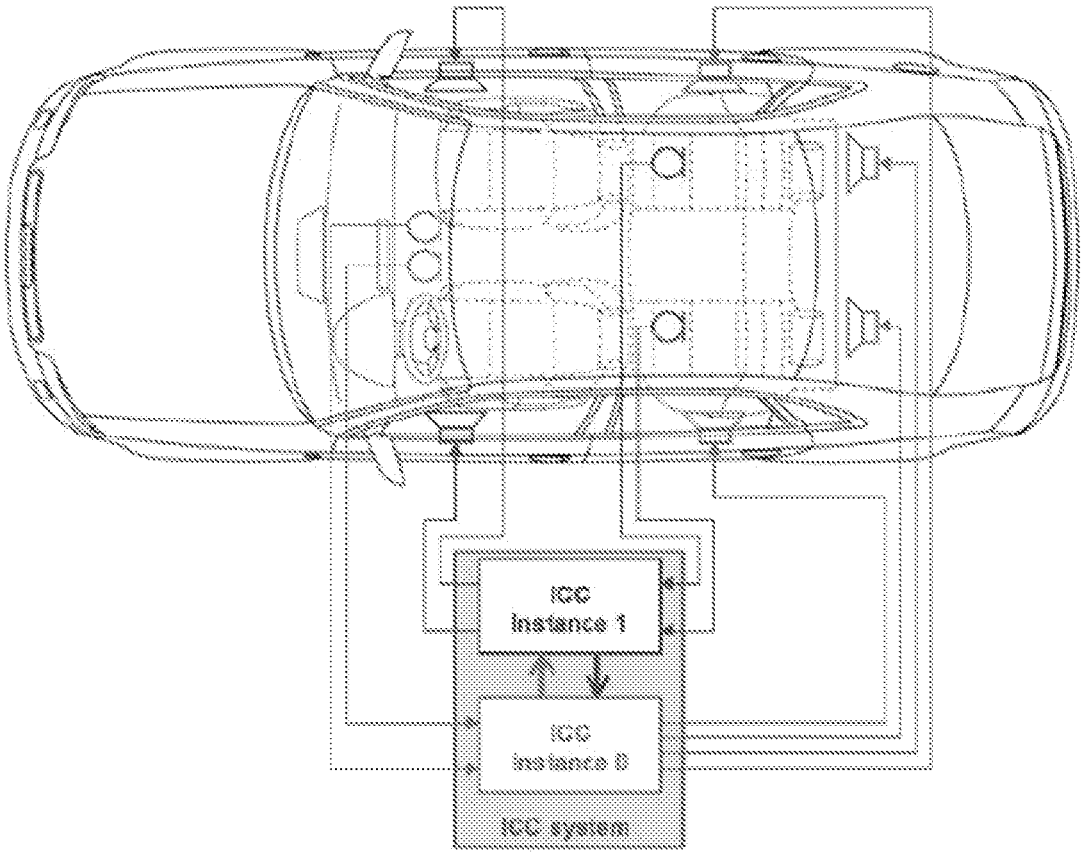
FIG. 1 shows an exemplary system for two acoustic zones which are represented by driver/front passenger and rear passengers (Prior Art)
Figure 2:
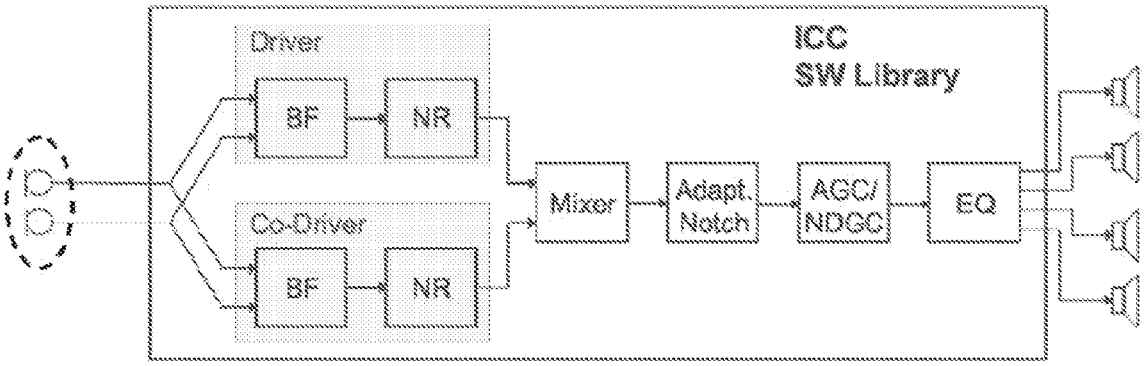
FIG. 2 shows an exemplary signal processing modules used in each of the two zones of the system of FIG. 1 (Prior Art)

The ICC system 309 may include various signal processing modules, as described above in connection with FIG. 2. Exemplary signal processing modules may include, without limitation, beamforming (BF), noise reduction (NR), signal mixing (e.g. for driver and front passenger), Automatic Gain Control (AGC), feedback suppression (notch), Noise Dependent Gain Control (NDGC) and equalization (EQ). Beamforming steers the beam of a microphone array to dedicated speaker locations such as the driver's or co-driver's seat. Noise reduction is employed to avoid or at least to moderate background noise transmitted over the ICC system. In addition, sibilant sounds may be reduced by a so-called deesser. Since speakers generally differ in their speaking habits, especially their speech volume, an AGC may be used to obtain an invariant audio impression for rear passengers irrespective of the actual speaker. Feedback suppression is generally needed to ensure stability of the closed-loop comprising loudspeaker, vehicle interior and microphone. The NDGC is used to optimize the sound quality for the listener, especially the volume of the playback signal. Additionally, the playback volume may be controlled by a limiter. Equalizing is required to adapt the system to a specific vehicle and to optimize the speech quality for the rear passengers.

The ICC system 309 may be implemented using hardware, software, or a combination thereof. The ICC system 309 may include a processor, a microprocessor, and/or microcontroller and various types of data storage memory such as Read Only Memory (ROM), a Random Access Memory (RAM), or any other type of volatile and/or non-volatile storage space.

In illustrative embodiments of the invention, the multi-zone ICC system 309 signal processing considers the different acoustic environments present in the multiple acoustic zones and their resulting psychoacoustic effects. To achieve this, ICC system 309 signal processing may include a speaker dedicated signal processing module 311 and/or a listener specific signal processing module 313, both of which may take into account/be triggered by their respective noise estimate.

One psychoacoustic effect that often occurs in a car vehicle is the Lombard effect. The Lombard effect or Lombard reflex is the tendency of speakers to increase their vocal effort when speaking in loud noise to enhance the audibility of their voice. This change includes not only loudness but may also include other acoustic features such as pitch and rate and duration of sound syllables. The Lombard reflex may occur, for example, when the speaker opens his window, or turns on the air conditioning/fan in front of him. In order to compensate for the Lombard effect of the speaker, a target peak level for the speech level in the speaker dedicated signal processing module 311 may be used which depends on the background noise at the speaker's location, in accordance with various embodiments of the invention.

In further embodiments of the invention, the characteristic of the deesser in the ICC system 309 may be modified for different acoustic environments. De-essing is a technique intended to reduce or eliminate excess sibilant consonants such as "s", "z" and "sh." Sibilance typically lies in frequencies anywhere between 2-10 kHz, depending on the individual. In exemplary embodiments, the deesser may, for example, scale the aggressiveness of the de-essing algorithm based, as least in part, on the expected noise masking effect.

To meet the listener's expectations concerning volume, audio quality and acoustic speaker localization, the gain characteristics of the NDGC in the ICC system 309 may be altered for several background noise levels, in accordance with various embodiments of the invention. For example, by using noise specific characteristics in the limiter module, peaks can be moderated individually in each loudspeaker signal.

For noise reduction, typically a compromise between residual noise and audible artifacts in the processed speech signal is made. Here, the masking effect of background noise may be utilized, in accordance with various embodiments of the invention. At high velocities which are generally characterized by a loud acoustic environment, parameterization may be performed in such a way that noise reduction is performed more aggressively. The resulting artifacts are not likely to be perceived by the listener until a certain extent. At low velocities, the focus can be on sound quality and less on suppressing background noise.

In further embodiments of the invention, different parameter sets may be used for equalizing, so as to balance speech quality and stability of the system. Several parameter sets may be trained offline depending on the driving situation. Beyond the purely sensor-driven signal processing, additional information can be used when vehicle signals, such as Controller Area Network (CAN) signals, e.g. velocity of the car or fan level, are provided.

Embodiments of the invention may be implemented in whole or in part in any conventional computer programming language such as VHDL, SystemC, Verilog, ASM, etc. Alternative embodiments of the invention may be implemented as pre-programmed hardware elements, other related components, or as a combination of hardware and software components.

Embodiments can be implemented in whole or in part as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made which will achieve some of the advantages of the invention without departing from the true scope of the invention.

What is claimed is:

1. An ICC system for a passenger compartment having acoustic zones, comprising:

a speaker dedicated module to receive first signals from a first microphone in a first one of the acoustic zones, wherein the first signals correspond to speech from a first user in the first one of the acoustic zones, wherein the first module is configured to maximize the speech from the first user and minimize signals not generated by the speech from the first user, wherein the speaker dedicated module is further configured to compensate for the Lombard effect based upon a target peak level for the speech from the first user corresponding to a level of background noise in the first one of the acoustic zones; and a listener specific module to optimize a first output signal, which comprises the speech from the first user, for a first loudspeaker in a second one of the acoustic zones including adjusting a volume of sound from the first loudspeaker based upon a noise estimate for the second one of the acoustic zones.

2. The system according to claim 1, wherein the passenger compartment comprises one of an automobile, a boat, and a plane.

3. The speech communication system according to claim 1, wherein the ICC system includes a deesser that processes the microphone input signal based, at least in part, on the acoustic environment.

4. The speech communication system according to claim 1, wherein the ICC system includes a noise dependent gain control (NGDC), wherein the NGDC includes a limiter module that uses noise specific characteristics in the acoustic environment(s) to process peaks individually in each loudspeaker output signal.

5. A computer-implemented method using one or more computer processes for an ICC system for a passenger compartment having acoustic zones, the method comprising:

receiving at a speaker dedicated module first signals from a first microphone in a first one of the acoustic zones, wherein the first signals correspond to speech from a first user in the first one of the acoustic zones;

maximizing the speech from the first user and minimizing signals not generated by the speech from the first user;

compensating for the Lombard effect based upon a target peak level for the speech from the first user corresponding to a level of background noise in the first one of the acoustic zones; and optimizing, at a listener specific module, a first output signal, which comprises the speech from the first user, for a first loudspeaker in a second one of the acoustic zones including adjusting a volume of sound from the first loudspeaker based upon a noise estimate for the second one of the acoustic zones.

6. The method according to claim 5, wherein the passenger compartment comprises one of an automobile, a boat, and a plane.

7. The method according to claim 5, further comprising de-essing, by the speaker dedicated signal processing module, the microphone input signal based, at least in part, on the acoustic environment.

8. The method according to claim 7, wherein de-essing includes scaling the aggressiveness of de-essing based on an expected noise masking effect.

9. The method according to claim 5, further comprising providing a Noise Dependent Gain Control (NDGC) having adjustable gain characteristics that vary based on background noise levels.

10. The method according to claim 9, wherein the NGDC includes a limiter module, the method further including, using, by the limiter module, noise specific characteristics in the associated acoustic environment(s) to process peaks individually in each loudspeaker output signal.

11. The method according to claim 5, further including processing the microphone input signals and/or forming the loudspeaker output signals based, at least in part, on a determined masking effect of background noise in the acoustic environment(s).

12. The method according to claim 11, further comprising performing increased noise reduction when the passenger compartment is moving at a high speed, compared to when the passenger compartment is moving at a low speed.

13. The method according to claim 5, further comprising utilizing a plurality of parameter sets in performing equalization on at least one of the microphone input signals and/or loudspeaker output signals.

14. The method according to claim 13, wherein one or more of the parameter sets are trained offline depending on the driving situation.

15. The method according to claim 14, further comprising utilizing at least one of acoustic sensor-driven sensor information and non-acoustic vehicle provided signals in determining the parameter sets.

16. A computer program product encoded in a non-transitory computer-readable medium for speech communication, the product comprising:

program code for receiving at a speaker dedicated module first signals from a first microphone in a first one of the acoustic zones, wherein the first signals correspond to speech from a first user in the first one of the acoustic zones;

maximizing the speech from the first user and minimizing signals not generated by the speech from the first user;

compensating for the Lombard effect based upon a target peak level for the speech from the first user corresponding to a level of background noise in the first one of the acoustic zones; and optimizing, at a listener specific module, a first output signal, which comprises the speech from the first user, for a first loudspeaker in a second one of the acoustic zones including adjusting a volume of sound from the first loudspeaker based upon a noise estimate for the second one of the acoustic zones.

* * * * *